US011166504B2

(12) United States Patent
Otashevich et al.

(10) Patent No.: US 11,166,504 B2
(45) Date of Patent: Nov. 9, 2021

(54) OUTER GARMENTS WITH HIDDEN INTERNAL SUPPORT AND BACK BODY SHAPING AND LIFT

(71) Applicant: LANE BRYANT PURCHASING CORP., Columbus, OH (US)

(72) Inventors: Lazar Otashevich, Midland Park, NJ (US); Su Son, New York, NY (US); Kate McLaughlin, Brooklyn, NY (US); Tung Ting Wong, Elmhurst, NY (US)

(73) Assignee: LANE BRYANT IPCO LLC, New Albany, OH (US)

( * ) Notice: Subject to any disclaimer, the term of this patent is extended or adjusted under 35 U.S.C. 154(b) by 123 days.

(21) Appl. No.: 16/388,157

(22) Filed: Apr. 18, 2019

(65) Prior Publication Data

US 2019/0320746 A1 Oct. 24, 2019

Related U.S. Application Data

(60) Provisional application No. 62/659,381, filed on Apr. 18, 2018.

(51) Int. Cl.
*A41D 1/06* (2006.01)
*A41D 31/04* (2019.01)
(Continued)

(52) U.S. Cl.
CPC ..... *A41D 31/04* (2019.02); *A41D 1/06* (2013.01); *A41D 1/14* (2013.01); *A41D 31/02* (2013.01);
(Continued)

(58) Field of Classification Search
CPC ..... A41D 1/06; A41D 2400/38; A41D 1/21; A41D 1/062; A41D 1/14; A41D 1/08; A41D 27/02; A41D 1/22; A41D 2300/22; A41D 2300/322; A41D 17/02; A41D 2600/10; A41D 13/1254; A41D 2500/20; A41D 2500/50; A41D 31/02; A41D 31/04; A41D 31/18; A41D 31/185; A41D 7/00; A41D 7/005; A41F 9/02; A41F 9/00; A41F 7/00; A41F 9/025; A41F 5/00; A41B 9/001; A41B 2400/38; A41B 11/14; A41B 9/04; A41B 9/14; A41B 9/08; A41B 9/02;
(Continued)

(56) References Cited

U.S. PATENT DOCUMENTS 541,334 A * 6/1895 Roschi ..... A41D 1/06 2/227
820,856 A * 5/1906 Ettinger ..... A41F 5/00 2/107

(Continued)

*Primary Examiner* — Robert H Muromoto, Jr.
(74) *Attorney, Agent, or Firm* — Hudak, Shunk & Farine Co. LPA

(57) ABSTRACT

A lower body outer garment, such as a pant or legging, is provided which has a construction and hidden support which helps to redefine the wearer's appearance. The support is in one embodiment provided in the form of internal mesh re-enforcing panels that lift the buttocks and flatten the tummy. The invention also relates to twill or denim fabric versions of the lower garment, and includes the front and rear power control panels having strategic hem placement to avoid cutting into fleshy areas on the wearer or to lift and sculpt both the front and backside of the wearer.

20 Claims, 7 Drawing Sheets

(51) Int. Cl.
*A41D 1/14* (2006.01)
*A41D 31/02* (2019.01)
*A41D 31/18* (2019.01)

(52) U.S. Cl.
CPC .... *A41D 2300/322* (2013.01); *A41D 2400/38* (2013.01); *A41D 2500/20* (2013.01); *A41D 2500/50* (2013.01)

(58) Field of Classification Search
CPC .. A41B 17/00; A41B 9/00; A41C 1/08; A41C 1/003; A41C 1/10; A41C 1/02; A41C 1/00; A41C 1/04; Y10S 2/919; A63B 2071/1241; A63B 71/12; A63B 71/1216; D04B 1/243
See application file for complete search history.

(56) References Cited

U.S. PATENT DOCUMENTS 887,610 A * 5/1908 Epstein et al. ..... A41D 1/21 2/221
957,893 A * 5/1910 Marville ..... A41B 11/14 2/409
1,149,271 A * 8/1915 Lazarus ..... A41F 9/02 2/237
1,286,798 A * 12/1918 Scheinman ..... A41D 1/21 2/221
1,292,719 A * 1/1919 Davis ..... A41F 19/00 2/337
1,712,072 A * 5/1929 Dodson ..... A41B 9/02 2/404
1,812,593 A * 6/1931 Karberg ..... A41F 9/02 2/237
2,034,312 A * 3/1936 Rubin ..... A41D 1/06 2/228
2,599,769 A * 6/1952 Macrae ..... A41D 1/08 2/228
2,787,792 A * 4/1957 Mikottis ..... A41D 1/21 2/221
3,068,871 A * 12/1962 Rapp ..... A41D 1/06 450/95
3,127,896 A * 4/1964 Puliafico ..... A41D 1/06 450/95
3,185,158 A * 5/1965 Gattuso ..... A41F 9/025 450/95
3,214,770 A * 11/1965 Smith ..... A41D 1/08 2/227
3,234,947 A * 2/1966 Bergstein ..... A41D 1/06 450/95
3,249,110 A * 5/1966 Bryan ..... A41B 11/12 450/95
3,431,562 A * 3/1969 Souders ..... A41D 1/21 2/221
3,435,462 A * 4/1969 Bank ..... A41D 1/06 2/227
3,457,926 A * 7/1969 Bacon ..... A41F 9/02 450/95
3,505,685 A * 4/1970 Granchelli ..... A41D 1/21 2/221
3,751,731 A * 8/1973 Bennett ..... A41D 1/06 2/227
3,859,667 A * 1/1975 Roy ..... A41D 1/14 2/212
4,069,513 A * 1/1978 Shiller ..... A41D 1/06 2/212
4,139,913 A * 2/1979 Garin ..... A41F 9/025 2/221
4,156,294 A * 5/1979 Horn ..... A63B 71/12 2/400
4,188,672 A * 2/1980 Kalso ..... A41F 9/025 2/221
4,280,229 A * 7/1981 Stein ..... A41D 1/21 2/221
4,506,390 A * 3/1985 Stern ..... A41D 1/21 2/221
4,803,740 A * 2/1989 Dawson ..... A41D 1/21 2/215
5,010,595 A * 4/1991 Stradley ..... A41D 1/06 2/227
5,033,126 A * 7/1991 Wruck ..... A41D 1/08 2/242
5,127,108 A * 7/1992 Weiss ..... A41D 1/06 2/220
5,163,184 A * 11/1992 Reardon ..... A41D 1/06 2/218
5,217,403 A * 6/1993 Nobbs ..... A41C 1/10 2/237
5,283,910 A * 2/1994 Flint ..... A41F 9/025 2/221
5,535,451 A * 7/1996 Tassone ..... A41D 1/06 2/227
5,675,842 A * 10/1997 Schaefer ..... A41D 1/062 2/221
5,689,832 A * 11/1997 Head ..... A41D 1/062 2/227
5,867,836 A * 2/1999 Quinones ..... A41F 9/02 2/236
5,888,118 A * 3/1999 Kishi ..... A41D 1/14 450/122
5,902,170 A * 5/1999 Ganz ..... A41B 9/00 450/94
5,946,730 A * 9/1999 Blair ..... A41D 1/06 2/227
6,035,448 A * 3/2000 Thomson ..... A41D 1/06 2/227
6,202,220 B1 * 3/2001 Rhoden ..... A41D 1/062 2/220
6,205,591 B1 * 3/2001 Wheeler ..... A41B 9/08 2/227
6,308,338 B1 * 10/2001 Caldwell ..... A41D 1/062 2/312
6,311,333 B1 * 11/2001 Batra ..... A41D 1/06 2/221
6,367,086 B1 * 4/2002 Woodard ..... A41D 1/06 2/227
6,543,062 B1 * 4/2003 Amsel ..... A41D 1/06 2/227
6,620,026 B1 * 9/2003 Guilani ..... A41C 1/10 128/96.1
6,665,882 B1 * 12/2003 Pedrick ..... A41D 7/005 2/228
6,922,849 B1 * 8/2005 Fedrick ..... A41D 1/062 2/227
D552,328 S * 10/2007 Smith ..... D2/742
D562,532 S * 2/2008 Brown, Jr. ..... D2/742
D577,878 S * 10/2008 Perrine ..... D2/742
D592,829 S * 5/2009 Kepekchyan ..... D2/742
7,574,752 B1 * 8/2009 Walters ..... A41D 1/062 2/227
8,074,298 B2 * 12/2011 Davenport ..... A41F 9/02 2/227
8,418,268 B2 * 4/2013 Waldman ..... A41D 1/06 2/248
8,683,616 B2 * 4/2014 Zielinski ..... A41D 1/14 2/76
8,813,266 B1 * 8/2014 Green ..... A41F 7/00 2/400
8,959,665 B1 * 2/2015 Garner ..... A41F 9/00 2/237
8,966,667 B2 * 3/2015 Peck ..... A41D 31/185 2/227
8,990,970 B2 * 3/2015 Lee ..... A41B 9/02 2/307
9,044,051 B1 * 6/2015 Rydman ..... A41D 1/062
9,119,426 B1 * 9/2015 Skanron ..... A41D 1/21
9,326,552 B2 * 5/2016 Hays ..... A41C 1/08
9,668,524 B2 * 6/2017 Harris ..... A41D 31/18
9,723,885 B2 * 8/2017 Shoraka ..... A41C 1/08
9,955,741 B2 * 5/2018 Roup ..... A41F 9/00

(56) References Cited

U.S. PATENT DOCUMENTS 10,123,573 B2 * 11/2018 Hays ..... A41C 1/08
10,285,457 B2 * 5/2019 Roup ..... A41D 1/14
10,575,565 B2 * 3/2020 Trebino ..... A41F 17/00
10,687,570 B2 * 6/2020 Strange ..... A41D 1/06
2002/0133865 A1 * 9/2002 Neman ..... A41B 9/08 2/170
2004/0006811 A1 * 1/2004 McKenzie ..... A41B 11/14 2/240
2004/0049834 A1 * 3/2004 Stangle ..... A41D 1/21 2/338
2004/0163159 A1 * 8/2004 Edwards ..... A41F 9/02 2/338
2005/0268379 A1 * 12/2005 MacGeorge ..... A41F 9/02 2/400
2006/0010571 A1 * 1/2006 Oakley ..... A41D 1/21 2/227
2007/0118954 A1 * 5/2007 Lee ..... A41C 1/003 2/69
2007/0136930 A1 * 6/2007 Dipietro ..... A41D 1/06 2/227
2008/0172769 A1 * 7/2008 Herget ..... A41D 1/21 2/76
2008/0189834 A1 * 8/2008 Leung ..... A41B 9/08 2/406
2008/0295225 A1 * 12/2008 Hendrickson ..... A41C 1/10 2/237
2008/0301855 A1 * 12/2008 Ball ..... A41F 9/025 2/237
2009/0031470 A1 * 2/2009 Ishikawa ..... A41D 1/06 2/69
2009/0049583 A1 * 2/2009 Stones ..... A41F 5/00 2/221
2009/0083894 A1 * 4/2009 Causey-Gabbe ..... A41B 9/08 2/78.1
2009/0210996 A1 * 8/2009 Hu ..... A41D 1/089 2/228
2009/0235431 A1 * 9/2009 Bevley ..... A41F 9/00 2/227
2009/0254017 A1 * 10/2009 Dumpson ..... A41C 1/10 602/67
2010/0136882 A1 * 6/2010 Malish ..... A41C 1/06 450/11
2010/0192283 A1 * 8/2010 Kim ..... A41D 27/02 2/227
2010/0192284 A1 * 8/2010 Simon ..... A41F 9/025 2/236
2010/0199399 A1 * 8/2010 Garza ..... A41D 15/002 2/24
2010/0235965 A1 * 9/2010 Frandsen ..... A41F 9/02 2/237
2011/0004976 A1 * 1/2011 MacGillivray ..... A41D 1/06 2/221
2011/0059678 A1 * 3/2011 Agassi ..... A41B 9/04 450/154
2011/0061147 A1 * 3/2011 Welfeld ..... A41C 1/08 2/237
2011/0099677 A1 * 5/2011 Mamiye ..... A41D 27/02 2/67
2011/0131705 A1 * 6/2011 Waldman ..... A41F 9/00 2/221
2011/0179556 A1 * 7/2011 Partovi ..... A41D 1/08 2/406
2012/0000007 A1 * 1/2012 Hansen ..... A41D 1/06 2/234
2012/0052770 A1 * 3/2012 Bhojwani ..... A41D 1/06 450/95
2012/0060253 A1 * 3/2012 Bergin ..... A41C 1/003 2/69
2012/0144548 A1 * 6/2012 Quaranta ..... A41B 17/00 2/69
2013/0019370 A1 * 1/2013 Dweck ..... A41D 7/00 2/67
2013/0095730 A1 * 4/2013 Jensen ..... A41C 1/003 450/95
2013/0145516 A1 * 6/2013 Zielinski ..... A41D 1/06 2/69
2014/0143930 A1 * 5/2014 Kuraoka ..... A41D 1/06 2/79
2014/0165265 A1 * 6/2014 Tulin ..... A41D 1/06 2/234
2014/0273741 A1 * 9/2014 Hays ..... A41D 1/06 450/95
2014/0273743 A1 * 9/2014 Hays ..... A41B 9/08 450/95
2014/0310854 A1 * 10/2014 Kianmahd ..... A41F 9/02 2/237
2015/0164151 A1 * 6/2015 James ..... A41D 1/06 450/95
2016/0120246 A1 * 5/2016 Boyle ..... A41D 1/06 2/227
2016/0206012 A1 * 7/2016 Hays ..... A41B 9/08
2017/0027252 A1 * 2/2017 Inzer ..... A41D 1/08
2017/0042257 A1 * 2/2017 Carrer ..... A41D 1/06
2019/0150540 A1 * 5/2019 Otashevich ..... A41D 1/06
2019/0320747 A1 * 10/2019 Otashevich ..... A41D 1/14

* cited by examiner

OUTER GARMENTS WITH HIDDEN INTERNAL SUPPORT AND BACK BODY SHAPING AND LIFT

FIELD OF THE INVENTION

The present invention relates to outer wear for the lower body, and more particularly, to pants including leggings and jeans, that redefine the appearance and reshape or sculpt a wearer's lower body, including the lower waist torso: i.e., the abdominal area and waist, the hips, thighs, buttocks and upper legs.

BACKGROUND OF THE INVENTION

Material advances of the last century have allowed fashion to move toward garments that both shape and move with the wearer. In particular, this has included the drive toward lower outerwear that accentuates the feminine figure. However, this trend has created a gap in the plus-size market, in particular for women who want to appear au current, but who are intimidated to dress in clothing that reveals rather than covers their shape. One answer is the use of internal under garments which compress and shape the wearer so as to provide a smoother and cleaner fit and/or appearance of the respective outerwear and the shapewear industry is a multi-billion dollar. However, this solution is expensive and can be uncomfortable and inconvenient, especially when the wearer wishes to relieve herself. The present invention is designed to provide an option in garments, including for example, pants or leggings, that allow these people to participate in these fashion trends. The invention can be constructed in a stretch knit fabric or in twill or denim style pants or leggings.

SUMMARY OF THE INVENTION

The present invention relates to an outer garment for the lower body, including for example, hosiery, leggings, pants, slacks, jeans, trousers and even skirts or dresses, which are structured so as to provide support and definition to the wearer's body, including, the waist, hips, abdominals, buttocks, thighs, and legs. The garment may advantageously extend down the leg to the mid-thigh, knee, mid-calf or ankle, although it should be understood that inventive features may be incorporated into garments having differing configurations.

The outer garment broadly termed "pants" herein, is preferably a fitted lower garment intended to be an external garment, and so having an appearance that is sufficiently formal and modest to be worn out and in public (i.e. that does not appear to be a pajama bottom, girdle, or stocking).

The invention is illustrated in denim style lower garments, often referred to as "blue jeans", where the color blue is traditional, but not necessary. In these embodiments, the garments may include more traditional side seams, rounded tab concealed front zipper openings on the center rise, and optional back and front pockets. In these styles, the garments may also feature a shallower stretch waist band with optional belt keeps, and pockets or pocket details in the back and front, which may be purely decorative or functional, depending, for example, on the desired profile and function.

In addition, in all embodiments, the lower garment includes mesh re-enforcement inner support which is integrated with the outer garment. In general, the lower garment includes a support assembly that provides 360° shaping, which means that the internal support system fully encircles the wearer such that the front, side, back, and waist, including the closure opening are all re-enforced, and the invention further includes full back coverage that helps to lift and smooth the wearer's butt. This control system has at least two (i.e. left and right) mating front side panels which are joined at the center rise seam or if present at the center zipper and the zipper includes the re-enforcement at the tab of the front closure, so as to form a front panel assembly, and mating back panels (i.e., left and right) which are joined at the back rise seam to form a back panel assembly. The front panel assembly is joined at the top to a stretch waistband and on the side to side seams. The rear panel assembly likewise includes corresponding left and right rear panels that extend substantially the full length of the butt area and are joined to the rear center rise, and in some embodiments, also on the inside to the crotch. Thus, the bottom of these control panels may be floating, or the panels join to form a crotch which is sewn together so as to form an under panty. The front and back panel assembly is joined together, either directly or through the medial side seams so as to encircle the wearer and form an inner belt assembly or panty that in some instances ends below the gluteal crease portion of the pant. Further, the control panels may be anchored along one or more vertical seams such as side seams (e.g., inside, outside), rise seams (e.g., front, back), and may be seamed at the crotch, either with the outer garment, or self-seamed. The control construct may also be fused to the outer fabric of the garment to form a single layer, and in this case, it is preferable that a stretch adhesive is used for the fusion.

The outer garment is preferably made of a stretch fabric that also provides shape and give, but which conceals the control panels that provide a greater degree of giving support so as to balance the degree of control with the wearer's comfort. In at least one embodiment, the control panels may comprise spandex and/or elastomeric, and preferably an open weave stretch mesh, and may be incorporated into the garment by sewing, gluing or adhering. Preferably, the controls panels are undercut (meaning that they are slightly undersized for the contour of the area that they cover) and are configured to accentuate the anatomy so that the transition between areas which include the control members and which do not form a smooth and un-intruded transition between the support and non-support sections of the garment. In particular, the bottom hem of the under panty is configured to either help to lift and tuck (for example in the back at the gluts) or to lie against a muscular transition (for example in the front and side at the top of the hip crease). Thus, the panels construction may include a set of back panels that end at a structural transition, such as at a natural transition such as below the gluteal tuck (i.e., the butt check crease) so as to provide support and definition to the muscle and adipose tissue that is superior to the bottom of the control panel and to the control panel hems. In addition, the front set of panels may include a front shape that curves upwardly from the side seam of the garment and which intersects the bottom of the front rise or zipper tab in the event that the garment includes a front closure, such as zipper opening which likewise includes the re-enforcement of a mesh panel. The side of the front panel can thus vary from being level to the front center depth to extending from 0.25 to 1, 1.5, 2, or as much as 5 inches below this level relative to a horizontal line taken across the front of the garment tangential to the highest point of the panel or panel assembly (or with a the low point below the crotch at the inner thigh) in front. Optionally, the garment may include pockets that overlay or incorporate the support panels.

Considered as a portion of a circle, the arc that is represented by the portion of the lower hem of the front panels may have a radius that is from 0.35 to 0.75, or preferably from 0.45 to 0.55 times the waist measurement of the garment, although it should be understood that the hem may be a rounded shape other than a portion of a circle. In a particular embodiment, the front control assembly may include two sets of front panel assemblies, such as an inner and an outer panel assembly having differing hem shapes, for example, where the inner assembly curves toward the center seam as described and the outer panel assembly extends below that on the wearer's inner thigh by a sufficient amount (from 025 to 3 inches or 2+/−0.5 inches) to avoid rolling. This feature is manifested in the garment by extending down the garment leg portion relative to the garment as compared to the user. Preferably in the design, the outer panels are also curved and cross over the hems of the inner panels so as to smooth the flesh thereunder. In a still further embodiment, the front control panels are integrated into the garment front fabric such as by fusing panels that extend from the waistband to a leg portion that represents the knee or the lower thigh (i.e. roughly to ¼ to ¾, or from ⅓ to ⅝s of the length of the leg portion of the garment.)

The further embodiments of the garments may also include style features such as back side yoke features, and optional darts to accentuate the rounded shape of the wearer's backside. The garment includes a back control panel assembly which may include, one or more of, left and right hip yoke control panels, and gluteal control panels which extend to the gluteal crease as previously described. The hip yoke typically has a left and right side where the yoke is seamed in the garment to a lower glut garment section. The bottom seam of the hip yoke panels may extend lower in the center from the mid-point of the panels and the lateral hem of the hip yoke panels may extend in a line up-ward toward the lateral side seam, or may curve downward, so that the lower hip yoke hem is round from the side seam to the center seam. It is preferred that the hip yoke panels of the present invention comprise a power fabric, such as a power mesh.

The control panels may form part of an interior lining or may be integrated with the exterior fabric of the garment and may extend from the top edge waistband seam of the outer garment to the lower control seams or even to the leg hems. The control panels may be anchored along one or more vertical seams such as side seams (e.g., inside, outside), center back seams, or any design seams (e.g., vertical stylish seams). One area of the interior re-enforcement sections may provide control to tone or more of the waist, abdomen, thigh and butt, which is advantageously achieved by a unique pattern and sizing of the control panels relative to the areas enveloped by them.

BRIEF DESCRIPTION OF THE DRAWINGS

FIG. 3(*b*) shows a different view of the detail of the zipper tab of FIG. 3(*a*);

FIG. 5(*a*) shows a detail of the of the interior view of the zipper tab of the lower garment of FIG. 5;

FIG. 5(*b*) shows a different view of the detail of the zipper tab of FIG. 5(*a*);

DETAILED DESCRIPTION OF THE INVENTION

Figures 1, 2:
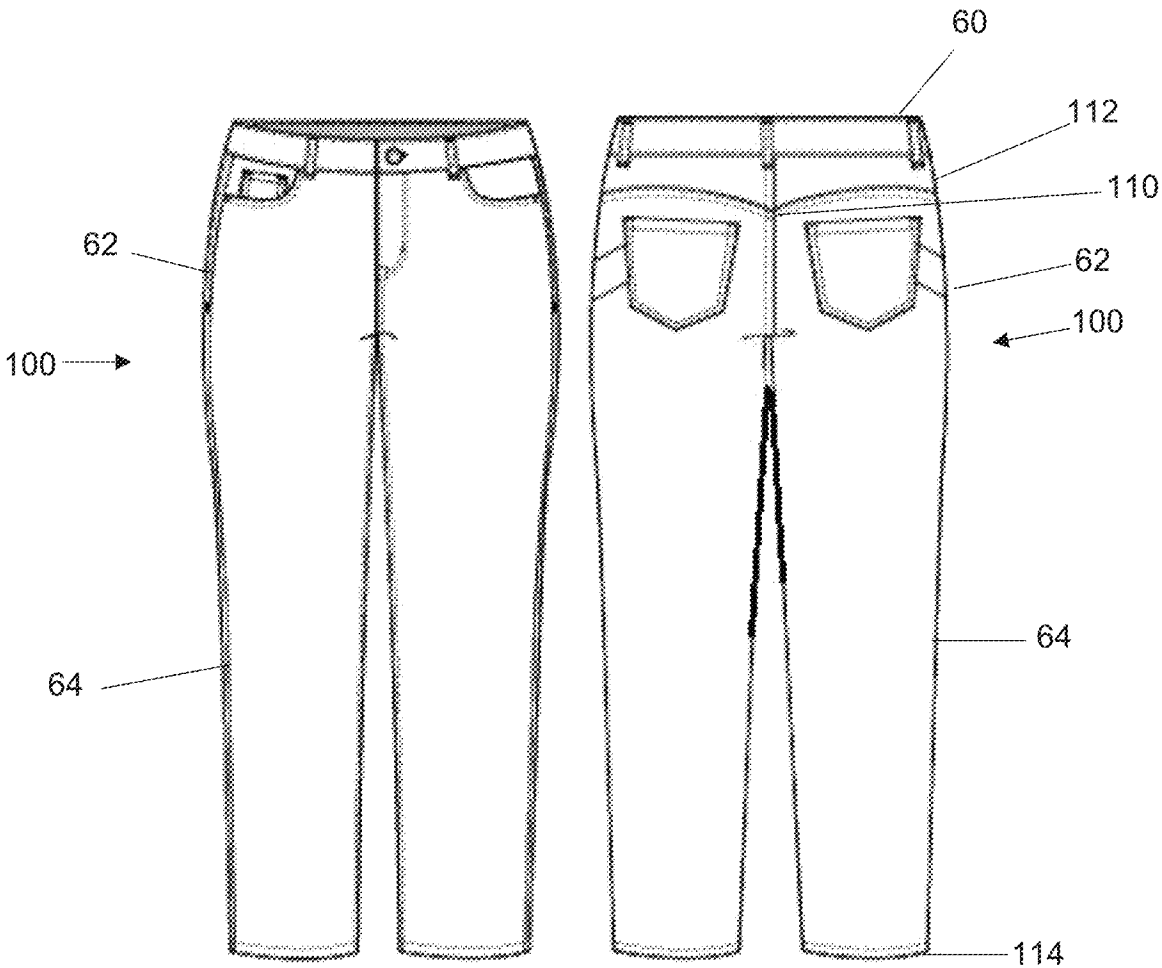
FIG. 1 shows a front view of the lower garment of the present invention.
FIG. 2 shows a back view of the lower garment of FIG. 1 including curved back yoke, pocket and diagonal double lateral back darts.

The present invention relates to lower outerwear, such as pants, trousers, leggings or skirts that have various features that collectively contribute to an outwear garment that redefines the appearance and the shape of the wearer. FIGS. 1-8 illustrate a lower body garment 100, termed a "pant" herein which includes sections such as a waist 60, side hip areas 62, and leg portions 64 and seams, such as re-enforced seams, including top-stitched lap seams as are typically represented in denim construction and including side seams 66, such as the outside seams 101 and inside seams 102, and center front rise seam 108 and center back rise seam 110 and additional seams that act to help define the appearance of the wearer in the garment, including seaming at a yoke portion 108 and darts 111, for example in the back of the pant over the glut medial area. At the waist area, the lower body garment 100 may comprise a top edge seam 106 which joins the lower torso assembly to a stretch waistband 60. At the bottom, the lower body garment 100 includes hem 114.

Inside, the lower body garment 100 may comprise a support assembly or construct 109 comprising assembled internal support panels, for example comprised of a mesh having a substantial amount of support, and a little stretch. The exterior of the lower body garment 100 may be made from a stretch fabric or power mesh, such as Lycra or Spandex, or more particularly of a rayon/nylon ponte with from 2 to 12 spandex, and more preferably 5%+/−2% spandex, which provides for control, comfort, and coverage and which interfaces with the construct in a manner so that the construct 109 such that the control construct 109 is not visible from the outside. For example, the outer garment 101 may be made of lycra, spandex or similar stretch or elastomeric fabrics and the control construct 109 may be made of a non-stretch mesh or a stretch fabric such as a two or four way stretch fabric or mesh with for example, nylon and a higher percentage of spandex, such as 15-40%, or more particularly, 20%+/−5%, that has a limited amount of give. The fabric is preferably an open weave fabric cut on the vertical or horizontal grain, but not the bias.

Figures 3, 3A, 3B:
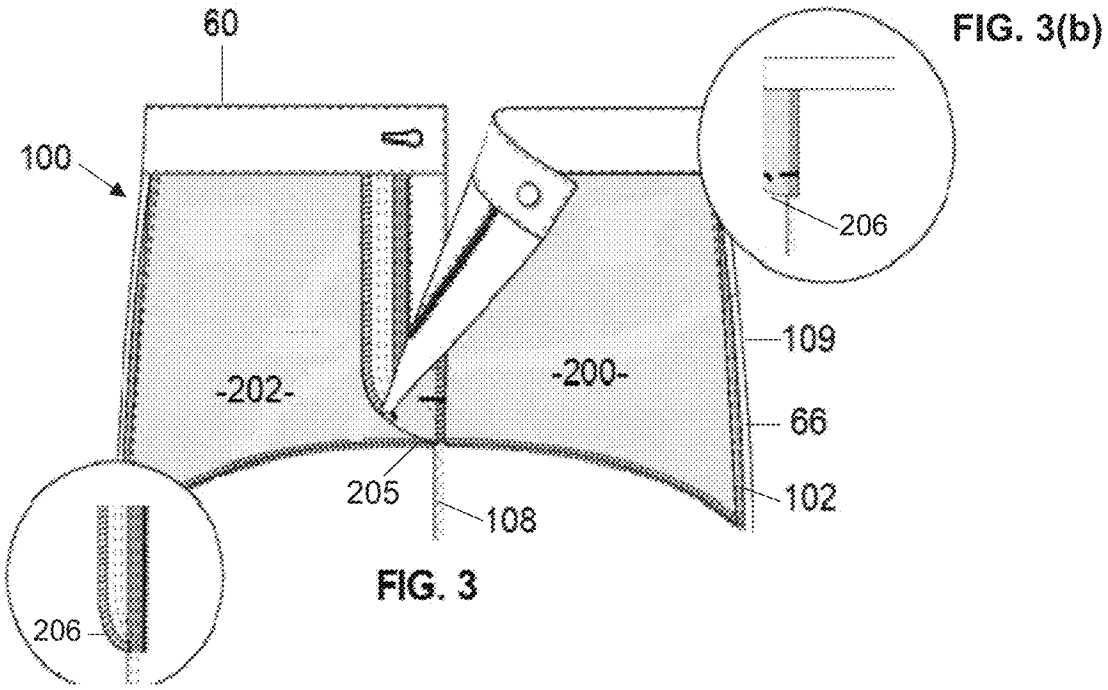
FIG. 3 shows the interior view of the front of the lower garment of FIG. 1, and FIG. 3(*a*) shows a detail of the interior view of the zipper tab of the lower garment of FIG. 1.
Figure 4:
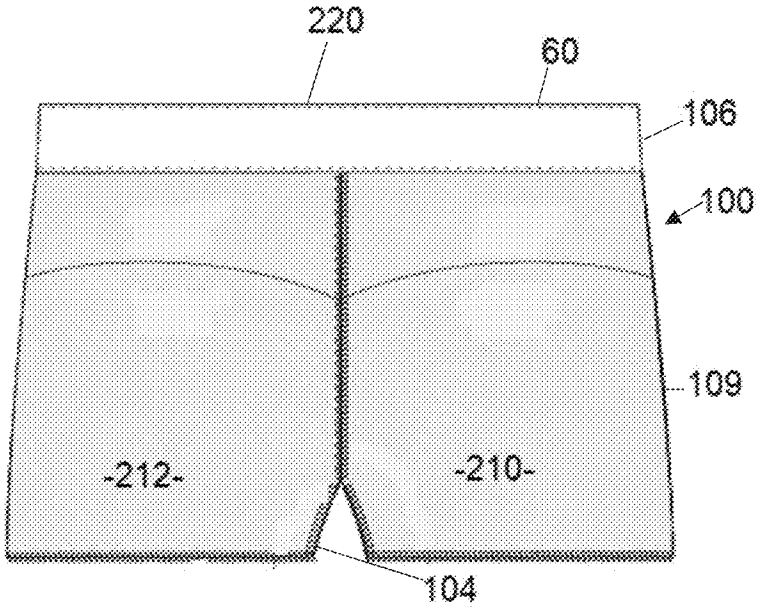
FIG. 4 shows the interior view of the back side of the lower garment of FIG. 1.

FIGS. 3-4 show the inside of the lower body garment 100, in which the construct comprises an assembly 109 of pieces, (i.e. which are joined by sewing them together, by sewing them into the construction of the garment, or by sewing or adhering them to the exterior garment). The assembly 109 includes a right 200 and a left 202 front abdominal panel here joined by a closure member 205, such as a front zipper or button tab including a front re-enforcement tab 206, also including the power mech re-enforcement, and left 210 and right 212 buttock portions. Preferably, the assemblage may further include a waistband 220, such as a waistband assembly shown in FIGS. 7 and 8. In the version shown in FIG.

7, this includes an outer self-covering 410, an adhered interlining 412, and an elastomeric ribbed waistband member 414. In the alternative version shown in FIG. 8, this includes an outer self-covering 510, an adhered interlining 512, and a stretch interior facing 514. The assemblage 109 may line the upper portion of the outer garment 100 inside both front and back and may end at or slightly above the hip crease in a portion that is attached within the interior of the leggings or may include a merrow finish and float. Accordingly, the assembly covers the full circumference of an interior lower waist area of the outer garment 100. In some embodiments, the assembly 109 may be anchored to the outer garment 100 for example, at the top edge seam 106 of the lower outer garment 100. The anchoring may be done by, for example, stitching or glue. In one non-limiting example, the anchoring may be done by ⅛ inch double needle stitch.

Moreover, in addition to anchoring at the top, the control assembly 109 may be optionally anchored along one or more vertical seams such as side seams (e.g., outside seam 102), rise seams (e.g., front rise seam 108 and/or the back rise seam 110), as well as at its crotch or at the crotch of the outer garment. The dotted line may be stitched to the front rise seam 108 (FIG. 3 shows the front inside) or back rise seam 110 (FIG. 4 shows the back inside). The side anchoring may be done by stitching (e.g., chain stitch) or glue. In some embodiments, the side anchoring may cover the full width of the assembly 109, that is, from the top edge to the bottom edge of the assembly 109. In some other embodiments, the side anchoring may cover only a partial length of the full width. For example, if the assembly 109 is 5 inches from top to bottom, the side anchoring may be 5 inches of stitching, or the stitching may just cover the top 3 or 4 inches. It should be noted 5 inches is just an exemplary number, and the assembly 109 may have a width that is reasonable to cover, at least partially, the lower abdominals of a wearer. For example, depending on the size and height of an intended wearer of the lower body garment 100, the assembly 109 may have different widths.

In some embodiments, the bottom edge of the assembly 109 may be floating, that is, not anchored to the outer garment 100, and therefore not include a seam that is observable from the exterior of the garment. For example, the assembly 109 may comprise two layers of lining fabric and the bottom of the two layers may be bound by stitching or glue, but may not be anchored to the outer garment 100. The bonding may be done by stitching (e.g., Merrow or purl stitches) or glue. In one embodiment, the two layers of fabric of the assembly 109 may be tricot mesh and these two layers may be bound together at the bottom edge by 1/16 inch Merrow edge stitch.

Figures 5, 5A, 5B:
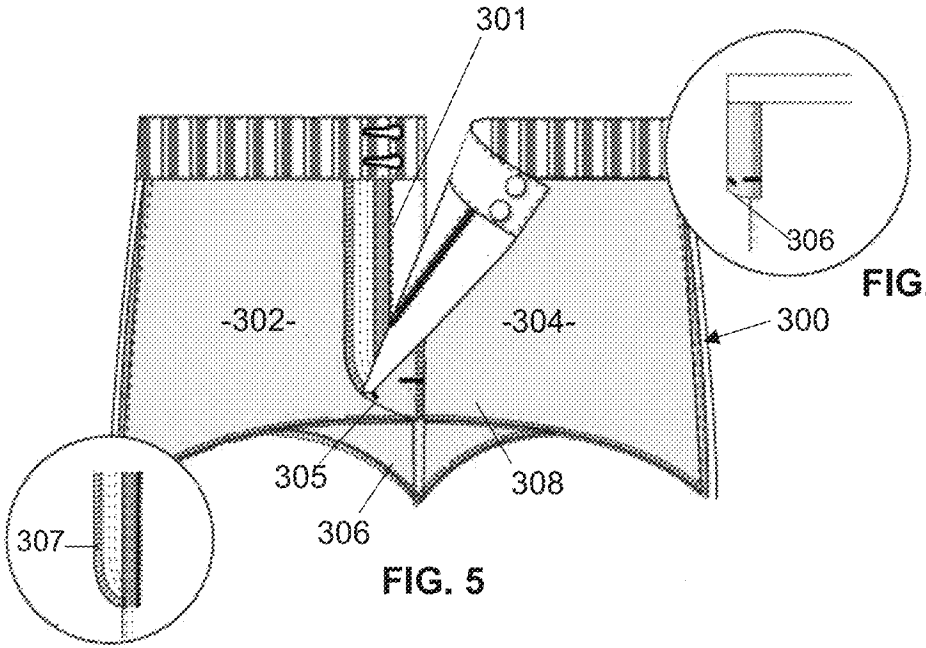
FIG. 5 shows an alternate embodiment of the garment of the present invention incorporating and additional interior panel.
Figure 6:
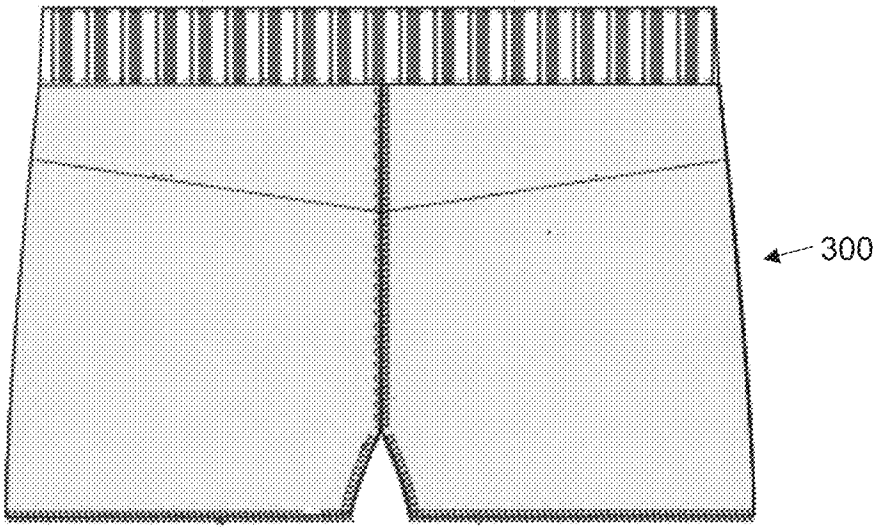
FIG. 6 shows an interior view of the back of the garment of FIG. 5.
Figure 7:
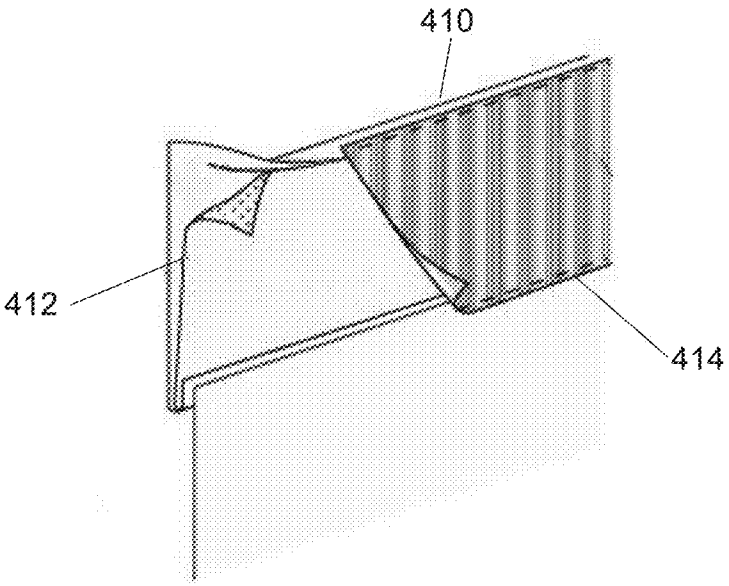
FIG. 7 shows a detail of the waistband of the garment of FIG. 5.
Figure 8:
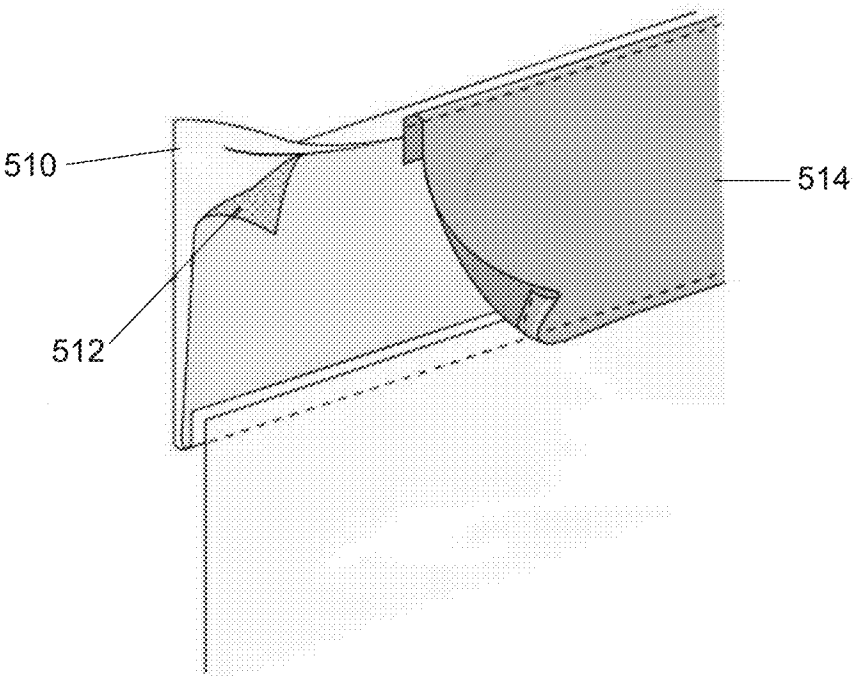
FIG. 8 shows an alternative embodiment of a waistband for the garment of the present invention.

As illustrated in FIGS. 3 and 5, the abdominal panels of the inner construct have a bottom boundary that is configured on each side so as to together form a C shape so that the lateral side is cut lower than the inside. Preferably, the front panels 200, 202 (302,303) end at the sides by attachment to the back panels 212, 210 so that the highest point of the bottom edge is medial to the wearer's outer hip crease and above the natural fold. Thus, the hem starts from a point that is forward of the side profile and roughly ⅕ to ⅓ of the way from the side edge (or the edge of the garment when empty and folded flat) to the center rise seam 108. This point of the bottom edge is also from ¼ to ¾, and preferably from ½ to ⅔ of the distance from the top seam 106 to the crotch intersection where the inside leg seam meets the front and back rise seams. The medial seam ends at the end of the closure assembly (here, the bottom of the zipper tab 204 which forms an interior face to the zipper 405 and the medial bottom of the control assembly falls above the crotch by 0.25-3 inches, and preferably from 1-2 inches.

The back panels 210, 212 extend slightly farther down the back body of the pant, i.e., below the crotch intersection and into the leg portions of the pants. The back assembly is joined at the crotch so as to form an interior panty and the panty is undercut relative to the buttock of the wearer to provide for lift and sculpting.

The present invention is shown as a pant including a front fly zipper and a button close waist, as well as bagged out top-stitched back pocket details. It is envisioned that this version of the lower garment of the invention is constructed from a woven fabric, such as a twill, and more specifically a woven stretch twill, including cotton, and synthetic denims and other relatively stiff woven materials.

FIG. 5 is an interior view of a further embodiment of the lower garment (i.e. pants) 300 which shows a left (right-side out) front control panel 302 and a right front control panel 304 joined at a front closure member 305 which have a level bottom seam 303 that extends in a curved line across the bottom of the front at or slightly (i.e. by 0.1 to 3, and preferably 0.25 to 1.5 inches) below the end of the front closure member tab 306. The tab 306 is rounded and includes an opposing zipper placket 307 that is bound to the left front panel by stitching including a merrow finish. In this embodiment, the control assembly further includes the front right and left panels 302, 304 which correspond to the panels of the assembly 202, 200, but also includes a further interior layer of panels 306, 308 that cross the more interior panels and which extend downward on the front rise to smooth the medial upper leg bulge. The control panels are seamed into the side seams 310 of the garment 300, and at the stretch waistband 308 is stitched to the top of the garment 300.

What is claimed is:

1. A pant having a right leg covering and a left leg covering which are integral at a superior region with a lower body member including a front body portion and a back portion, all having an intersection at a crotch member; and an inner control assembly comprising a mesh fabric and having a front abdominal portion that has opposing lateral sides and a medial center and a lower boundary that defines a single upward arc from the opposing lateral sides towards the medial center, and a back gluteal portion, and the front abdominal portion is joined to the back gluteal portion, and front abdominal portion and the back gluteal portions each have a left lateral side and a right lateral side, and the left lateral side of the front portion is joined to the right lateral side of the back gluteal portion and the right lateral side of the front portion is joined to the left lateral side of the back gluteal portion, and at least a portion of the front abdominal portion terminates on the right side and on the left side superiorly to the crotch member and the back gluteal portions each terminate below the crotch member and the pant includes side seams on the lateral sides, and the inner control assembly is seamed with the pant in the side seams the inner control assembly has an upwardly curved lower boundary.

2. A pant as set forth in claim 1, wherein the inner control assembly has a lower boundary that floats relative to the pant.

3. A pant as set forth in claim 1, wherein the pant has a size according to standard garment sizing and the inner control assembly is 3% smaller by volume than the standard size of the pant.

4. A pant as set forth in claim 3, wherein the inner construct assembly is 5% smaller by volume than the standard size of the pant.

5. A pant as set forth in claim 1, wherein front abdominal portion and the back gluteal portions each have a left lateral side and a right lateral side, and the left lateral side of the front portion is directly joined to a first medial panel which is directly joined to the right lateral side of the back gluteal portion and the right lateral side of the front portion is directly joined to a second medial panel which is directly joined to the left lateral side of the back gluteal portion.

6. A pant which is a jean having a right leg outer covering and a left leg outer covering which are integral at a superior region including a crotch member with an outer lower body member including a front body portion having an ingress zipper and a back portion, and a first inner control assembly comprising a front control portion having a length extending downward toward the superior region of the right leg covering or the left leg covering and a first front control assembly portion side and a second front control assembly portion side which extend a front control length I toward the superior region of the right leg covering and the left leg covering and the front control assembly portion length I is longer than the length of the ingress zipper, and the back control portion having a first back control assembly portion side and a second back control assembly portion side, and the front control assembly portion is joined at the first front control assembly portion side to the first back control assembly portion side and at the second front assembly control portion side to the second back control assembly portion side, and at least a portion of the front control assembly portion terminates on the right side and on the left side superiorly to the crotch member, the inner control assembly has an upwardly curved lower boundary and the pant further includes a second inner control assembly which extends superiorly to the length of the first inner control assembly at the zipper and which is integral to an interior surface of the lower body member.

7. A pant as set forth in claim 6, wherein the pant comprises denim, and the additional interior support construct comprises power mesh.

8. A pant as set forth in claim 6, wherein the ingress zipper is incorporated into a center front seam of the pant, and the first inner control assembly includes a mesh re-enforcement portion for the zipper.

9. A pant as set forth in claim 6, wherein the second inner control assembly terminates within the leg coverings but at a length superior to the end of the right leg covering and the left leg covering.

10. A pant as set forth in claim 9, wherein the second inner control assembly is fused to the pant and the termination of the second inner control assembly is scalloped.

11. A pant comprising denim or twill and having a front center ingress zipper and having a right leg covering and a left leg covering which are integral at a superior region having a first crotch with a lower body member including a front body portion and a back portion and an inner control construct comprising a front abdominal portion, and a back gluteal portion, and the front abdominal portion is joined to the back gluteal portion, and front abdominal portion and the back gluteal portions each have a left lateral side and a right lateral side, and the left lateral side of the front portion is directly or indirectly joined to the right lateral side of the back gluteal portion and the right lateral side of the front portion is directly or indirectly joined to the left lateral side of the back gluteal portion, and the distal end of the front abdominal portion includes a curve across the width of the garment such that at least a portion of the front abdominal portion terminates on the right side and on the left side below the front center ingress zipper but superior to the termination length at the join with the back gluteal portions.

12. A pant as set forth in claim 11, wherein the garment comprises denim, and the inner control construct comprises power mesh.

13. A pant as set forth in claim 12, wherein the pant is a pair of jeans.

14. A pant as set forth in claim 11, wherein the ingress zipper is incorporated into a center front seam of the pant.

15. A pant as set forth in claim 11, wherein the pant includes an intermediate front control construct which is between the inner control construct and the pant lower body portion and the intermediate front control construct has an inferior termination that expends inferior to the terminal edge of the control construct at the front center ingress zipper of the pant.

16. A pant comprising denim or twill and having a front center ingress zipper including a zipper tab that has a power mesh re-enforcement, and the pant having a right leg covering and a left leg covering which are integral at a superior region having a first crotch with a lower body member including a front body portion and a back portion and an inner control construct comprising a front abdominal portion, and a back gluteal portion, and an intermediate control construct, and front abdominal portion and the back gluteal portions each have a left lateral side and a right lateral side, and the left lateral side of the front abdominal portion is directly or indirectly joined to the right lateral side of the back gluteal portion and the right lateral side of the front abdominal portion is directly or indirectly joined to the left lateral side of the back gluteal portion, and the distal end of the front abdominal portion includes a curve across the width of the garment such that at least a portion of the front abdominal portion terminates on the right side and on the left side below the front center ingress zipper but superior to the termination length at the join with the back gluteal portions, and the intermediate control construct is positioned between the lower body member of the pant and the inner control construct and the distal end of the intermediate control construct is not co-terminal with the end of the front abdominal portion.

17. A pant as set forth in claim 16, wherein the terminal end of the intermediate control construct has a double curve and the terminal end of the inner control construct has a single curve.

18. A pant as set forth in claim 17, wherein the double curve of the intermediate control construct curves superiorly in the center of each leg covering so that the inner portion is longer than the center portion.

19. A pant as set forth in claim 18, wherein the center of the distal end of the intermediate control construct is longer than the center of the distal edge of the inner control construct.

20. A pant as set forth in claim 1, wherein pant includes a gluteal crease area and the back gluteal portions end below the gluteal crease.

* * * * *